US005863006A

United States Patent [19]

Thrasher

[11] Patent Number: 5,863,006

[45] Date of Patent: Jan. 26, 1999

[54] ROCK CRUSHER

[75] Inventor: Allen R. Thrasher, Floydada, Tex.

[73] Assignee: Texas Crusher Systems, Inc., Aspermont, Tex.

[21] Appl. No.: 731,091

[22] Filed: Oct. 9, 1996

[51] Int. Cl.[6] ..... B02C 19/00

[52] U.S. Cl. ..... 241/275

[58] Field of Search ..... 241/5, 275, 285.1

[56] References Cited

U.S. PATENT DOCUMENTS

| | | | |
|---|---|---|---|
| 9,091 | 2/1880 | Read . | |
| 229,787 | 7/1880 | Withee . | |
| 3,174,697 | 3/1965 | Bridgewater . | |
| 3,174,698 | 3/1965 | Miller . | |
| 3,346,203 | 10/1967 | Danyluke | 241/275 |
| 3,358,939 | 12/1967 | Gasparac et al. . | |
| 3,540,667 | 11/1970 | Parker . | |
| 4,326,676 | 4/1982 | Rose . | |
| 4,390,136 | 6/1983 | Burk | 241/275 |
| 4,513,919 | 4/1985 | Terrenzio . | |
| 4,560,113 | 12/1985 | Szalanski . | |
| 4,690,341 | 9/1987 | Hise et al. | 241/275 |
| 4,834,298 | 5/1989 | Murata et al. | 241/275 |
| 4,844,354 | 7/1989 | Watajima . | |
| 4,896,838 | 1/1990 | Vendelin et al. . | |
| 4,921,173 | 5/1990 | Bartley . | |
| 4,923,131 | 5/1990 | Rossouw et al. | 241/275 |
| 5,145,118 | 9/1992 | Canada . | |
| 5,248,101 | 9/1993 | Rose et al. . | |

FOREIGN PATENT DOCUMENTS

| | | | |
|---|---|---|---|
| 452590 | 10/1991 | European Pat. Off. | 241/275 |
| 0276848 | 8/1988 | France | 241/275 |
| 0276849 | 8/1988 | France | 241/275 |

*Primary Examiner*—Mark Rosenbaum
*Attorney, Agent, or Firm*—Wendell Coffee

[57] ABSTRACT

The rotor of a vertical shaft impact rock crusher is balanced by placing steel balls in a hollow ring attached around the top of the rotor. The vanes within the impeller are constructed to form rock shields on the forward or impact side of the vanes. Rocks are fed into the impeller upon a free floating table. The top of the free floating table is protected by a tungsten carbide disc. Therefore the rocks are moved from the table at reduced rotational velocity less than that of the rotor and are struck by the rapidly rotating rock faces of the rock shield. Ports are placed close to the trailing or back side of the vanes. The top, bottom, and trailing lip of the ports are protected by tungsten carbide pins which are adhered within steel pipes by epoxy. The pins are mounted upon a door by welding to the door which covers the ports. The door may be replaced for ease and rapidity in replacing the pins. The pin along the trailing lip of each port is supported by a seat of weld metal. The rotor is made from a single steel casting. The exterior of the rotor is cylindrical and has nothing attached to it. Therefore the rotor has nothing to be knocked loose or damaged by bouncing rocks.

17 Claims, 4 Drawing Sheets

ROCK CRUSHER

CROSS REFERENCE TO RELATED APPLICATION

None, however, Applicant filed Disclosure Document Number 398,939 on May 28, 1996 which document concerns this application; therefore, by separate paper it is respectfully requested that the document be retained and acknowledgment thereof made by the Examiner. (MPEP 1706)

BACKGROUND OF THE INVENTION (1) Field of the Invention

This invention is related to vertical shaft impact rock crushers. Rock crusher operators have ordinary skill in this art.

(2) Description of the Related Art

Impact rock crushers have been known for over thirty years. See Miller U.S. Pat. No. 3,174,698 and Bridgewater U.S. Pat. No. 3,174,697. However before this invention the crushers had two major problems. The first was vibration. By adding a large mass of rocks to be crushed the rocks would flow into a impeller rotating at high speed in uneven amounts. With the changing flow of the rocks within the impeller the impeller would almost always be imbalanced and vibrate accordingly.

Another problem was the abrasion. The rocks moved over metal parts within the rotors or impellers and their movement would quickly abrade the parts. Also, larger rocks impacting the impellers required them to be of rather heavy material.

The abrasion problem was at least in part alleviated by forming rock packs or packed material in pockets to provide the surface that the rocks abraded. Such structure is shown for example in Bridgewater U.S. Pat. No. 3,174,697 as well as Canada 5,145,118, Bartley 4,921,173, Terrenzio 4,513,919, Szalanski 4,560,113 and Watajima 4,844,354. The Szalanski rock pack of FIG. 5 is of particular interest.

The maintenance costs of a rock crushers is a considerable amount. Before this invention, the cost of replacing worn parts of the rock crusher could be as high as the 10% of the value of the rock crushed.

It is has been known for over a hundred years that a fluid or fluidlike material could be placed within the rings on spinning structure such as Withee 229,787. However, generally these have been used only upon structures which do not have the magnitude of unbalance such as the rotors of rock crushers. For example, Withee was concerned with balancing a millstone which would have basically been symmetrical in any event. He suggested that the fluidlike material could be shot, sand or water.

SUMMARY OF THE INVENTION (1) Progressive Contribution to the Art

This application discloses solutions to some of the problems in the prior art. First, a hollow ring is placed upon the top of the rotor along the sidewall of the rotor. It is circular and filled with about sixty pounds of steel balls with oil. As is known the spherical balls will act as a fluid and will move to balance the rotor. As the rocks within the rotor change the center of gravity, the fluid (balls) within the ring will move to restore balance.

To reduce abrasion, a free-floating table is placed in the rotor over the bottom of the rotor. When the rocks are fed into the rotor the table will not be revolving as fast as the rotor. Therefore the rocks will not be slung from the table with the same force as if the table turned at the same speed as the rotor. Also, this will permit an ample rockpile to build on the table.

Although the free-wheeling plate is designed to have less abrasion some will be present. Therefore the tungsten carbide disc will be placed upon the top of the table, protecting the entire top of the table.

Vanes are arranged having a pocket formed on the leading face of the vanes. This will form a rock pack with a rock face or surface which entirely covers the leading face of the vanes and therefore prevents abrasion to the leading face.

Also, this will prohibit the vanes from being battered by high-speed rocks. The rocks will come off the free-floating table without a great rotational velocity. Therefore they will impact upon the rock surface on the leading face of the vanes and will not contact the trailing face of the vane. The trailing face of the vane will form an obtuse angle to a radial line. However because of the higher speed of the rotation of the rotor and rock face the rocks will be struck by the rock surface formed against the leading face of the vane. The rocks will abrade rock against rock to the ports.

The trailing lip of each of the ports is protected by a tungsten carbide pin. The rock packs and rock surfaces will form above the top edge of the port and below the bottom edge of the port and there will be rocks sliding across these lips. Therefore these edges are also protected by tungsten carbide pins.

The tungsten carbide pins are mounted within steel tubes to give back support to the pins. Within a few minutes of installation the face of the steel tube will be abraded away by the rocks traveling over the pin. However, the back side will not be abraded away and will support the brittle tungsten carbide.

Although the pins have been designed for reduced breakage and there will be a certain amount of abrasion and the tungsten carbide pins will require replacement periodically.

To permit easier replacement, the pins are mounted upon a steel door or plate which is attached to the inside of the rotor over the ports. The mounting plates will have an opening within them the same place as the ports. The steel tubes will be welded to the steel plates. Also, the tungsten carbide pin at the trailing lip will be placed in a pocket formed in the rotor housing to support the steel tube which in turn supports the pin.

It is estimated that the total maintenance including inspection can be reduced to no more than 1% of the value of the crushed rock.(See Appendix)

(2) Objects of this Invention

An object of this invention is to reduce the cost of crushing rocks by reducing the maintenance of rock crushers by reducing the abrasion and vibration damage to the rock crusher.

Thus an object of this invention is to provide a balancer for balancing rotating parts of a vertical shaft impact rock crusher.

Further an object of this invention is to form better rock packs and rock surfaces to protect the parts of rock crushers.

Still further objects of this invention is to provide better support for tungsten carbide pins and abrasion areas of a rock crusher.

Still further objects are to control the paths of rocks within a rock crusher to prevent their high speed movement of the rock impacting any surface other than a rock pack.

Further objects are to achieve the above with devices that are sturdy, compact, durable, lightweight, simple, safe, efficient, versatile, ecologically compatible, energy conserving, and reliable, yet inexpensive and easy to manufacture, install, operate, and maintain.

Other objects are to achieve the above with a method that is rapid, versatile, ecologically compatible, energy conserving, efficient, and inexpensive, and does not require highly skilled people to install, operate, and maintain.

The specific nature of the invention, as well as other objects, uses, and advantages thereof, will clearly appear from the following description and from the accompanying drawings, the different views of which are not necessarily scale drawings.

CATALOGUE OF ELEMENTS

Figure 1:
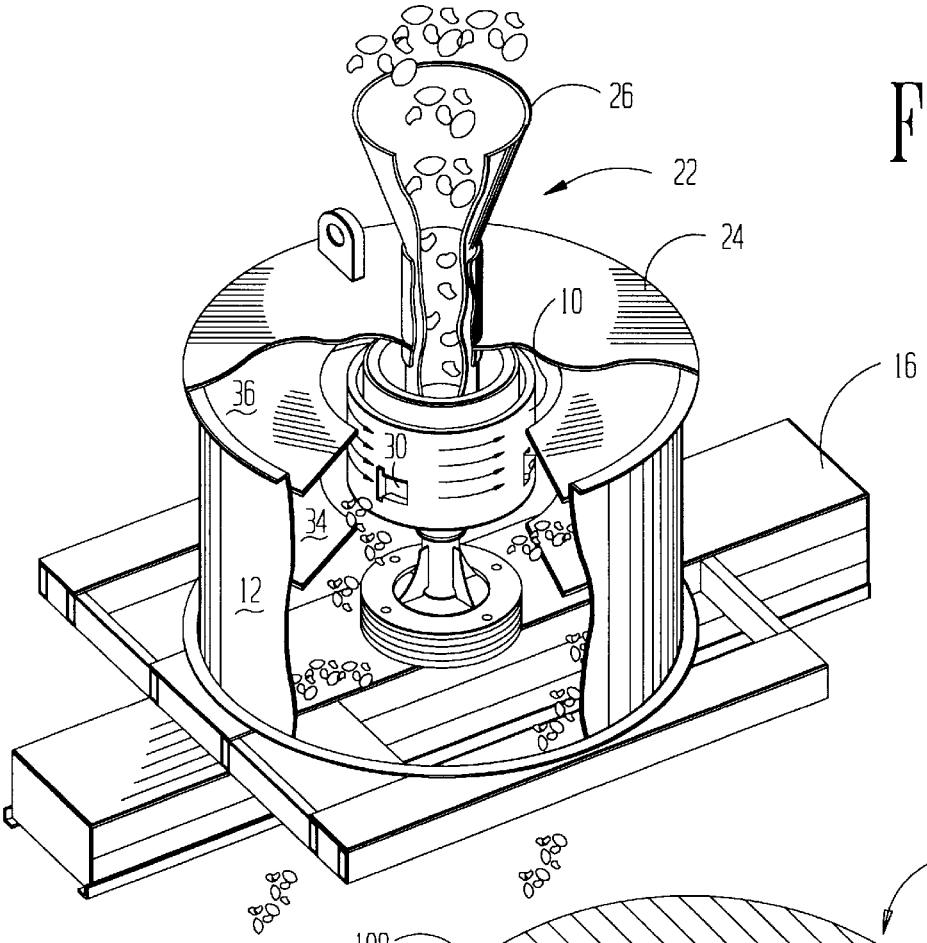
FIG. 1 is a perspective view of an embodiment of this invention with parts broken away to show details of construction.

As an aid to correlating the terms of the claims to the exemplary drawings, the following catalog of elements and steps is provided:

| | |
|---|---|
| 10 | rotor |
| 12 | container |
| 14 | vertical shaft |
| 16 | framework |
| 17 | bearings |
| 18 | motors |
| 20 | beltdrive |
| 22 | feeder |
| 24 | top, container |
| 26 | funnel |
| 28 | tube or chute |
| 30 | ports |
| 32 | anvil, pack of rocks |
| 34 | lower shelf |
| 36 | top shelf |
| 38 | balancer base plate |
| 40 | rotor top |
| 42 | tore, ring |
| 44 | ring top |
| 46 | opening |
| 48 | plug |
| 50 | steelballs |
| 52 | oil |
| 54 | cylindrical wall |
| 56 | protection plate |
| 58 | vanes |
| 60 | rotor bottom disc |

-continued

| | |
|---|---|
| 62 | inner edge |
| 64 | bolt |
| 66 | nut |
| 68 | leading face |
| 70 | trailing face |
| 72 | dashed line |
| 74 | rock shield |
| 76 | trailing lip |
| 78 | leading lip |
| 80 | rock face |
| 82 | bottom lip |
| 84 | top lip |
| 86 | axial bore |
| 88 | stub shaft |
| 90 | table disc |
| 91 | shims |
| 92 | bearing |
| 93 | lugs |
| 94 | tungsten carbide disc |
| 96 | steel ring |
| 100 | pin |
| 102 | steel pipe |
| 103 | 6" opening |
| 104 | door or mounting plate |
| 106 | outside face |
| 108 | slot |
| 110 | seat |
| 112 | pattern plate |
| 114 | brass pin |
| 116 | weld metal |
| 117 | weld rod |
| 118 | horizontal carbide pins |
| 120 | pipe |
| 122 | inside door face |
| 124 | bolts |
| 126 | top flange |
| 128 | clips |
| 130 | nut |

DESCRIPTION OF THE PREFERRED EMBODIMENTS(S)

Referring to the drawings there may be seen the representation of a rock crusher according to this invention. The rock crusher includes as its principal element rotor 10 which is surrounded by container 12. The rotor is mounted upon vertical shaft 14 which is connected by bearings 17 to framework 16 and container 12. The shaft is driven by one or more motors 18 by belt drive 20. The rotor 10 is made of a single steel casing. The side wall of the rotor is a single unitary cylindrical shell of metal. The exterior of the rotor is cylindrical and has nothing attached to it. As used herein the term "cylindrical" refers to a right circular cylinder. Therefore the rotor has nothing to be knocked loose or damaged by bouncing rocks.

Feeder 22 is attached to top 24 of the container 12. The feeder as illustrated is in the form of a funnel 26. The lower part of the funnel or chute or tube 28 extends to below top 40 of the rotor 10.

Therefore in basic operation, rocks are fed into the feeder 22 into the spinning rotor 10 to be slung from ports 30 in the rotor to impact anvil 32. The anvil may take many different forms, in some instances it is a massive piece of metal that the rocks impact against. However, preferably the anvil is a pack of rocks 32 formed in the container 12.

Lower shelf 34 is built onto the container. The shelf is at a level somewhat below the bottom of the rotor. The rocks from the rotor will build up on the shelf and therefore this will form the rock pack or anvil 32 wherein other rocks will be impacted and crushed. Top shelf 36 is built onto the container above the shelf 34. The crushed rocks will fall between the lower shelf 34 and the framework supporting the bearings 17.

Those having skill in the art will recognize that the description to this point is old, well-known and commercially on the market.

Figure 8:
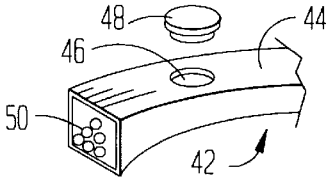
FIG. 8 is a detail of a part of the balancing ring.
Figure 2:
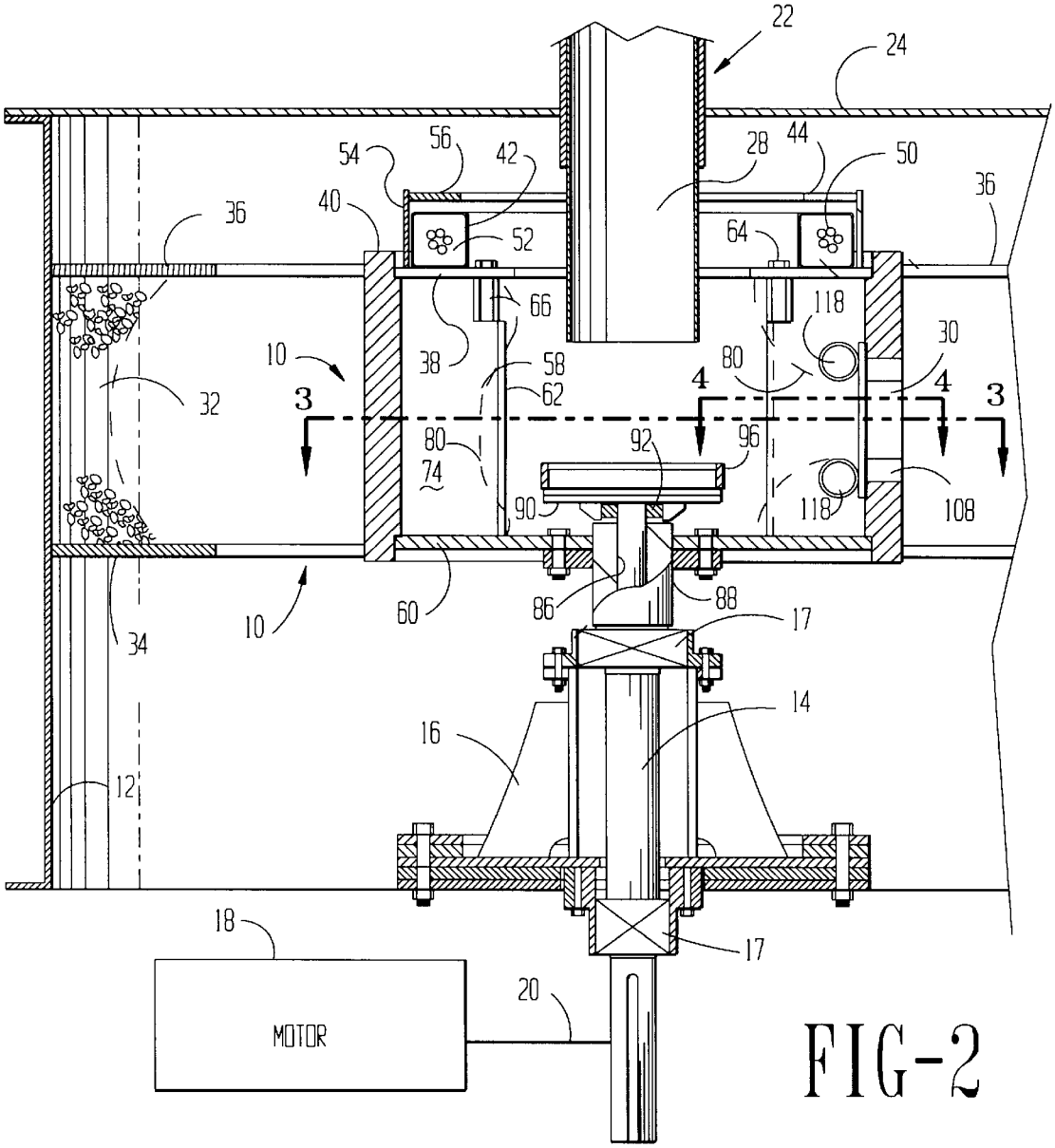
FIG. 2 is an axial sectional view of the principal working parts of rock crusher taken on line 2—2 of FIG. 3.
Figure 4:
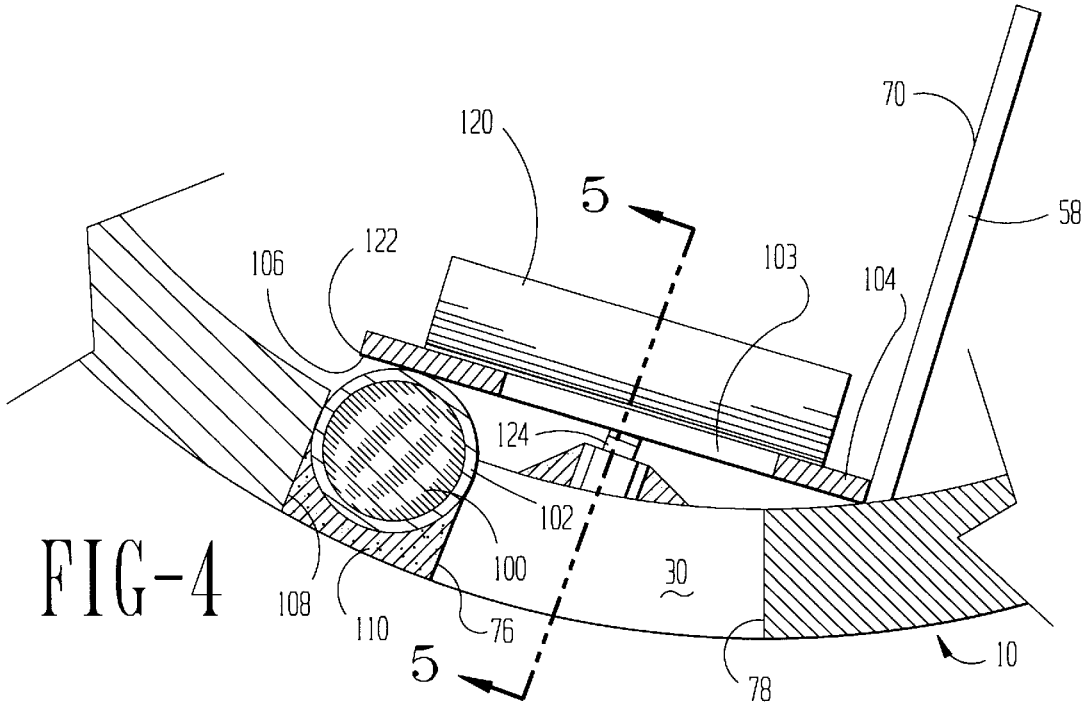
FIG. 4 is a sectional view across a port and door taken substantially along line 4—4 of FIG. 2 and line 4—4 of FIG. 5.
Figure 6:
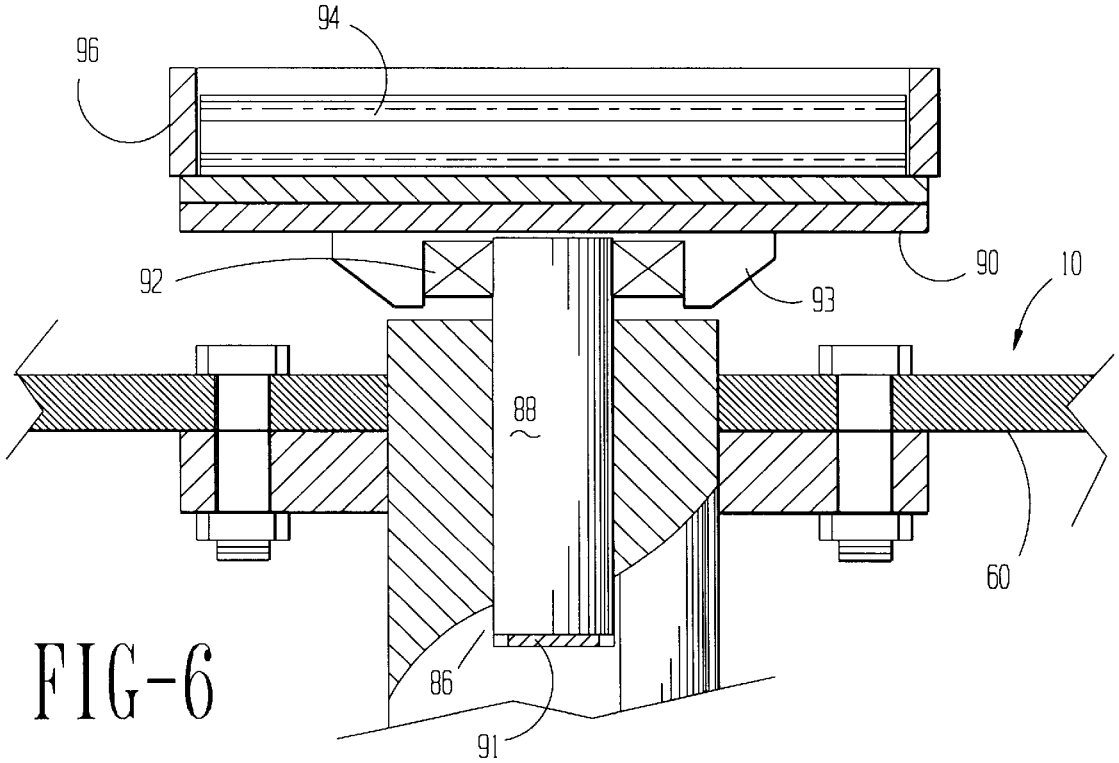
FIG. 6 is a axial sectional view of the free-wheeling table taken substantially along line 6—6 of FIG. 3.
Figure 7:
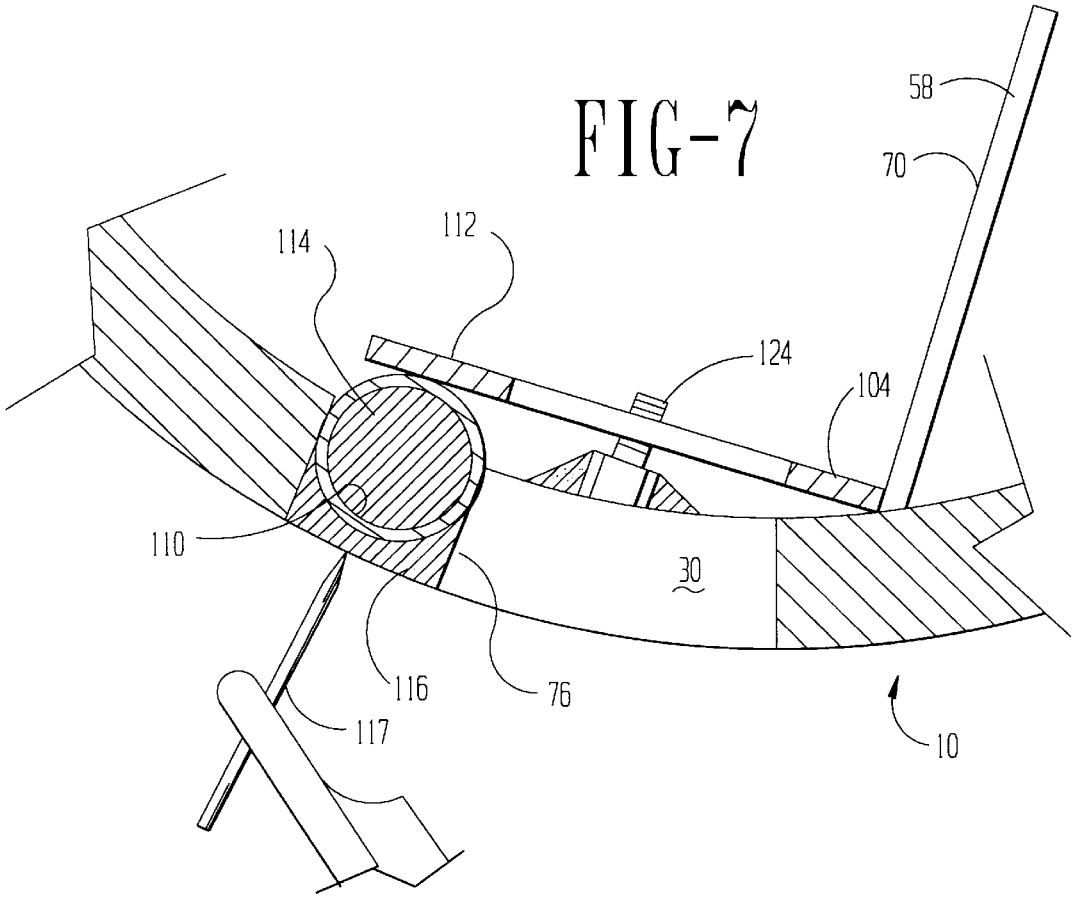
FIG. 7 is a sectional view similar to FIG. 4 showing the preparation of the seat.
Figure 5:
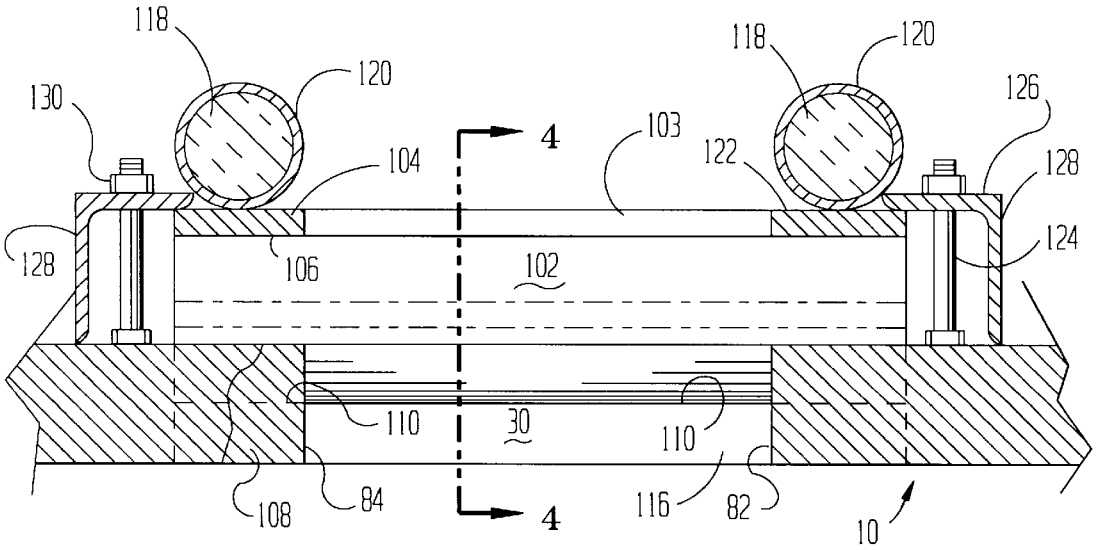
FIG. 5 is a sectional view of the door and port taken substantially along line 5—5 of FIG. 3 and line 5—5 of FIG. 4.

Balancer base plate 38 is attached to the rotor top 40. A tore or hollow ring 42 is mounted on top of the base plate 40. The ring will have a square cross section about 4" wide and 4" in height. Ring top 44 includes a 1" diameter opening 46 with plug 48 therein (FIG. 8). By means of the opening 46 dense fluid may be inserted into the ring 42.

"Fluid" is used in its broadest sense, meaning a substance (as a liquid) tending to flow to the outline of its container. Both mercury and metal spherical balls 50 and many other substances would be included in this definition of fluid.

It has been found that about sixty pounds of steel balls works well. The balls will be subject to considerable wear and therefore they should be of a wear resistant ball, for example, made from chrome steel alloy. It has also been found that dividing the balls so that there are about twenty pounds of balls of ¾" in diameter, twenty pounds of ½" in diameter, and twenty pounds of ⅜" in diameter works well. After the balls have been loaded into the tore 42, it is filled with oil 52. For convenience it is only necessary to fill the space about 90% full of the oil.

It is necessary to have sufficient balls and weight within the ring 42 to sufficiently balance it. Although sixty pounds is desired, normally more than about forty pounds is necessary. Protection plate 56 is attached to a balancer base plate 38. The protection plate is attached to cylindrical wall 54 which is spaced about ½" outboard of the ring 42. The protection plate 56 will extend about 4" from the cylindrical wall 54 and therefor will be within an inch of the edge of the ring. It has been found that this is sufficient clearance to protect the ring from damage.

It will be noted that the tube or chute 28 extends into the rotor below the bottom of the balancer base plate 38.

Three vanes 58 are mounted in the rotor 10. These vanes are made from flat plate and extend from the rotor bottom disc 60 to the balancer base plate 38. The vanes are made from half inch steel plate. At inner edge 62 on the top each vane 58 has a nut 66 welded in place. The nut 66 receives and is threaded to bolt 64 pending through the ring protector plate. Thus the inside top edge of the vanes is anchored in place. Each vane is securely fixed to the sidewall and rotor bottom disc.

The direction of rotation is indicated upon the drawings by an arrow. The forward face of vane 58 is designated as forward or leading face 68. The opposite face of the vane is the trailing face 70. The leading face will be at an acute angle to the inside of the rotor 10 at the connection point. By acute angle it is meant that the leading face will be at an acute angle to a tangent to the circle defining the inside of the rotor. Likewise the trailing face 70 will form an obtuse angle to the inside of the rotor 10 at that point. If the line projected from the trailing face is projected as shown by the dashed line 72 in the drawings (FIG. 3) it would be about ten inches from the axis of the rotor. For one design of the rotor, the rotor will have an inside diameter of approximately thirty-six inches and therefore a radius of eighteen inches. Calculation will show that the acute angle will be approximately 70° and the obtuse angle approximately 110°.

Figure 3:
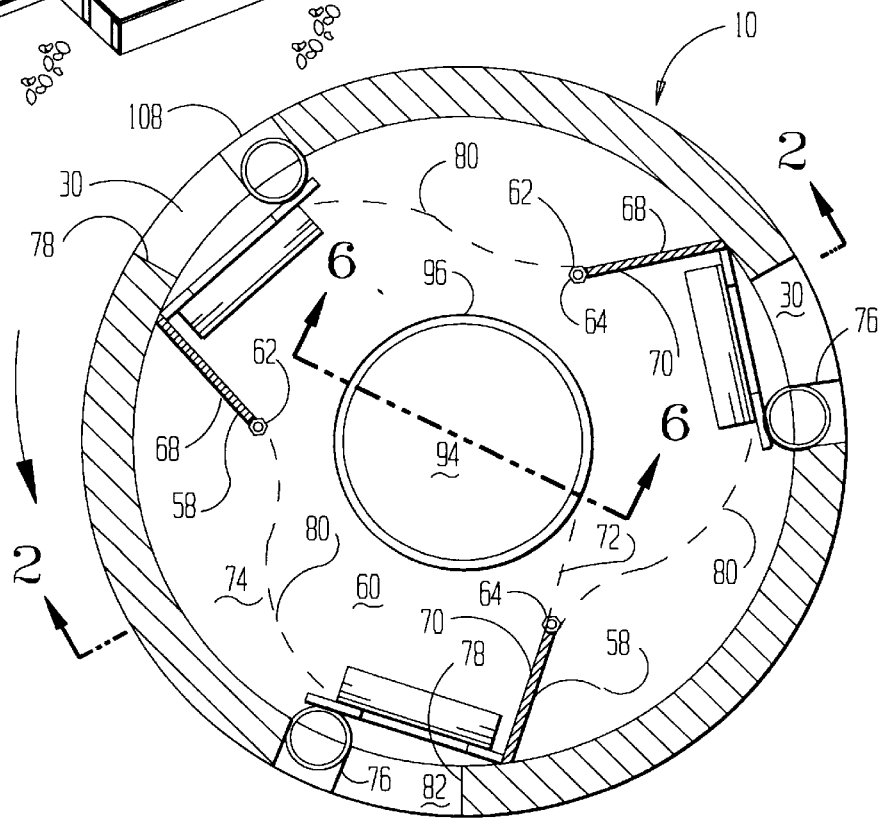
FIG. 3 is a cross-sectional view of the rotor according to this invention taken substantially on line 3—3 of FIG. 2.

The height of the rotor will be about 24" and the height of the ports 30 will be about 6". The ports are located about 6" above the bottom plate of the rotor and about 8" from the bottom of the ring protection plate. Referring to FIG. 3 it may be seen that rock shield 74 will build up from the leading face 58 of the vane. This rock face will extend to trailing lip 76 of each port 30. The leading lip 78 of each of the ports 30 is spaced about 2" from the trailing face 70 of each vane 58.

As will be explained later the entering rocks will have a very low rotational velocity from the chute. Therefore incoming rocks will impact upon the rock shield 74. Therefore once the rock shield is established shortly after the beginning of the use of the rotor, the vanes will be protected from incoming rocks. The rocks will work by centrifugal force downward along face 80 of the rock shield. Therefore after the initial installation, the rocks will impact and move along the rock shield 74 and not upon any of the structural parts of the rotor.

Likewise a similar rock shield will build up from the disc 60 of the rotor to bottom edge or lip 82 of each port 30. Another rock shield will build from the bottom of the ring base plate 38 to the top edge or lip 84 of the port 30. It is possible to establish these rock shields because of the vast reduction of the vibrations obtained by the self-balancing action of the balls 50 within the balancing ring 42.

The rotor 10 is attached by the disc 60 to the top of the vertical shaft 14. The top of the vertical shaft 14 has an axial bore 86. Table pin or stub shaft 88 telescopes within the axial bore 86. Table disc 90 is mounted around bearing 92. The bearing 92 fits on the top of the pin 88. Four projecting lugs 93 depend from the bottom of the table disc around the bearing holding it in position. The table does not rotate with the shaft 14. Although the table may have some rotation, its rotational speed will be much less than the rotational speed of shaft 14. Thus it is a free rotating table on bearings.

The diameter of the table disc 90 is less than half of the inside diameter of the rotor. The tube 28, the shaft 14, and the table are co-axial. The tube 28 is directly over the center of the table. When the rocks are fed into the rotor they are not fed onto a structural member which is spinning at the speed of the rotor. Therefore the rocks are discharged from the table at a rotational speed much lower than that of the rotor. Therefore the rocks impact the rock shield 74 rather than a structural member within the rotor. Stated otherwise, the slow moving rocks are struck by the rapidly moving rock shield.

To reduce abrasion across the top face of the table, a tungsten carbide disc 94 is mounted upon the top of the table disc 90. Steel ring 96 is fashioned around the table disc and the carbide disc about 1½" thick is cemented or adhered within the ring and onto the table disc. It is adhered in place by epoxy.

As the tungsten carbide disc 94 wears down, shims 91 may be placed below the stub shaft 88 in the bore 86 therefore restoring the table top to a desired location. This forms a means for raising the table top. For it to properly form the rock faces it is desired that the top of the table be approximately level with the bottom of the ports. Likewise, it is desired to keep a proper shape to the anvil or rock pack 32 formed between the container shelves 34 and 36. Mainly because of the different characteristics of the rocks, stones, or material which are fed into the rock crusher, it may be necessary to adjust the positions of the container shelves 34 and 36. This is mainly necessitated by the different variety of rocks found in geographic locations.

Those with ordinary skill as rock crusher operators will understand how to place shims below the stub shaft 88. Likewise, those with ordinary skill will understand how to adjust the container shelves 34 and 36 to form a properly operating anvil.

It is necessary to protect the edges of each port 30. The three ports 30 are all protected in the same way therefore the description will be the same for any one of the three.

The major abrasive action is at the trailing lip 76 protected by pin 100. In fact, so slight is the abrasion at the leading lip 78 no measures are taken to protect the leading lip.

The pin 100 is made of tungsten carbide and is 3" in diameter and 12" long. The tungsten carbide pin 100 is telescoped within steel tube or pipe 102 which has an outside diameter of 3⅜" and which is 12" in length. The inside diameter of the pin is slightly larger than 3" so that the tungsten carbide pin can be placed inside. The tungsten carbide pin 100 is adhered in place by epoxy.

The pin 100 in the pipe 102 is placed upon a plate or door 104. The door is made of ½" steel plate and has an outside dimension of 12"×11". The pipe 102 is welded to an outside face 106 of the plate. Adjacent to the pipe 102 is a square opening 6"×6" which is positioned to align or register with the port 30 which is also 6"×6". The 12" edge of the door will be parallel to the vertical shaft 14. The 11" dimension of the door will be parallel to the top lip 84 and bottom lip 82 of the port.

The exact dimensions of the ports may be adjusted to result in good shape for rock shield 74. This adjustment is within ordinary skill.

A slot 108 is cut through the rotor 10 to receive the pipe 102. To accommodate the pipe it is necessary that the slot be 12" long therefore it would project 3" above and 3" below the port 30. A nest or seat 110 is fashioned in the slot 108. To fashion the seat a dummy or pattern is made by attaching brass pin 114 3⅜" diameter to pattern plate 112. The plate 112 is positioned over the port 30 the same as the door in use. With the pattern plate 112 and the brass pin 114 in place, weld metal 116 is placed by a welding rod 117 onto the rotor in the slot to fill the space between the edges of the slot and the brass pin. The weld metal will not adhere to the brass and therefore after a seat is formed by the weld metal 116, the brass pin may be removed leaving a seat fashioned to fit the pipe 102 when it is installed. Therefore it may be seen that the pipe 102 is supported by the seat 110 in the rotor 10 and does not depend entirely upon the attachment to the door for its support.

Two horizontal pins 118 are attached to the door 104 so that when the door is positioned they are along the bottom and top lips 82 and 84. The horizontal tungsten carbide pins 118 are mounted similar to the pin 100. That is to say that each of them are telescoped within a pipe 120 which has an inside diameter of about 1½" to receive the 1½" horizontal pin which is held in place by epoxy. Then one pipe 110 is welded so that it will be along the top lip 84 and the other so it will be along the bottom lip 82. The pipes 120 are welded to the inside face 122 of the door 104.

As previously stated the width of the door will be 11". The 6" square opening 103 will be spaced 2" from the edge away from the pin 100. This edge of the door butts the trailing face 70 of the vane 58. The port will also have its leading lip 78 2" inches from the trailing face 70 of the vane 58.

Therefore it may be seen that the top and bottom lips and the trailing lip of the port are protected by the tungsten carbide pins. There will be a certain abrasion of the tungsten carbide pins but they are protected from breakage by their support within the pipes in which they are encased. The pipes themselves are protected by being welded to the door and also the pin 100 and its pipe 102 is supported by its seat 110 made of the weld metal 116.

A bolt 124 is welded onto the inside face of the rotor 10 above and another bolt 124 below the door 104. Each of the bolts 124 are inserted through an opening in top flange 126 of angle clips 128. Nut 130 upon each bolt clamps the top flange 126 of the clip 128 against the inside face 122 of the door. The rock packs extending above and below the top and bottom lips of the ports will cover and protect the bolts and nuts from abrasion and impact of the uncrushed rocks within the rotor. It is anticipated that the doors with their tungsten carbide protected pins will require replacing about once every 8 months. It is not expected that any other part of the rock crusher will require replacement more often than one year.

It will be understood that in a fraction of an hour after the pins are installed within their pipes that the pipes will be abraded away on the surfaces that the rocks transverse. After that portion of the pipe is gone the tungsten carbide pin within them is exposed to the movement of the rocks across the pin. The tungsten carbide pins are expected to have a life measured in months rather than hours.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. In a rock crusher having a) a vertical rotatable shaft having a top, b) a motor mechanically connected to the shaft for rotating the shaft, c) a rotor connected to the top of the shaft, d) a feeder located above the shaft adapted to feed rock into the rotor, e) a side wall on the rotor enclosing the rotor, f) ports in the side wall, and g) an anvil horizontally surrounding and enclosing the rotor, h) said rotor having a bottom, i) so arranged and constructed that rocks fed into the rotor when rotating will be slung from the ports against the anvil;

the improved structure for reducing maintenance by reducing abrasion within the rotor comprising:

j) a free rotating table on bearings above the bottom of the rotor, k) said table mounted co-axially with said rotor and said shaft and rotatable thereto.

2. The structure as defined in claim 1 further comprising:

l) an abrasion resistant top on said table.

3. The structure as defined in claim 2 wherein said abrasion resistant top is tungsten carbide.

4. The structure as defined in claim 1 further comprising:

l) a stub shaft inserted in an axial bore in the top of the shaft, m) a bearing on the stub shaft supporting the table, and n) means between the table and rotatable shaft for raising the table relative to the top of the rotatable shaft.

5. In a rock crusher having a) a vertical rotatable shaft having a top, b) a motor mechanically connected to the shaft for rotating the shaft, c) a rotor connected to the top of the shaft, d) a feeder located above the shaft adapted to feed rock into the rotor, e) a side wall on the rotor enclosing the rotor, f) ports in the side wall, and g) an anvil horizontally surrounding and enclosing the rotor, h) so arranged and constructed that rocks fed into the rotor when rotating will be slung from the ports against the anvil;

the improved structure for reducing maintenance by reducing vibration of the rotor comprising:

i) a circular hollow ring along the side wall attached to the side wall, and j) dense fluid in the ring.

6. The structure as defined in claim 5 wherein said dense fluid is in the form of steel balls.

7. The structure as defined in claim 6 wherein said steel balls are k) larger than about ¼ inch and smaller than about 1 inch.

8. The structure as defined in claim 6 further comprising:

k) oil covering said balls.

9. The structure as defined in claim 6 wherein said ring is connected along a top of said side wall, k) the steel balls have a total weight of more than about 40 lbs., l) the steel balls are about evenly divided by weight as ⅜", ½", and ¾" steel balls, and m) the hollow ring is connected along a top at said side wall and filled with oil around the balls to about 90% of the volume of the ring.

10. In a rock crusher having a) a vertical rotatable shaft having a top, b) a motor mechanically connected to the shaft for rotating the shaft, c) a rotor connected to the top of the shaft, d) a feeder located above the shaft adapted to feed rock into the rotor, e) a side wall on the rotor enclosing the rotor, f) ports in the side wall, and g) each port having a leading lip and trailing lip, and h) an anvil horizontally surrounding and enclosing the rotor, i) so arranged and constructed that rocks fed into the rotor when rotating will be slung from the ports against the anvil;

the improved structure for reducing maintenance by reducing abrasion around ports comprising:

j) an abrasion resistant lip pin mounted on each of the trailing lips, k) each of said pins parallel to said shaft, l) said pin constructed of a metallic carbide compound, m) said pin telescoped and adhered within a metal pipe, and n) said pipe welded in position at the trailing lip.

11. The structure as defined in claim 10 further comprising:

o) said pin constructed of tungsten carbide.

12. The structure as defined in claim 10 further comprising:

o) said pipe resting on a seat formed in said rotor shell.

13. The structure as defined in claim 10 further comprising:

o) a top pin attached along a top of each of the ports, and p) a bottom pin attached along a bottom of each of the ports, and q) said top and bottom pins telescoped and adhered in the same manner as the lip pin.

14. The structure as defined in claim 13 further comprising:

r) all pins for a port attached to a mounting plate, s) said mounting plate having a rectangular opening therein which matches the port, and t) each of said mounting plates attached to the inside of the side wall over a corresponding port.

15. In a rock crusher having a) a vertical rotatable shaft having a top, b) a motor mechanically connected to the shaft for rotating the shaft, c) a rotor with a top and a bottom connected to the top of the shaft, d) a feeder located above the shaft adapted to feed rock into an opening in the top of the rotor, e) a side wall on the rotor enclosing the rotor, f) ports in the side wall, g) each port having a leading lip, a trailing lip, a top and a bottom, h) a vane extending into the rotor from the sidewall adjacent each port, i) each vane having a leading face and a trailing face;

j) an anvil horizontally surrounding and enclosing the rotor, k) so arranged and constructed that rocks fed into the rotor when rotating will be slung from the ports against the anvil;

the improved structure for reducing maintenance by reducing abrasion by forming a rock face entirely covering the leading face of each vane comprising:

l) the leading face of each vane forming an acute angle with the side wall, m) the trailing face of each vane forming an obtuse angle with the side wall, n) each leading lip on each port adjacent to a trailing face of the adjacent vane, o) a circular hollow rind alone the sidewall attached to the side wall, and p) steel balls in said ring.

16. The structure as defined in claim 15 further comprising:

q) oil covering said balls, r) the steel balls have a total weight of about 60 lbs., s) the steel balls are about evenly divided by weight as ⅜",½", and ¾" steel balls, t) the hollow ring is connected along a top at said side wall and filled with oil around the balls to about 90% of the volume of the ring, u) each port having a height from top to bottom about equal to a width from the leading lip to the trailing lip, v) the distance from the bottom of each port to the bottom of the rotor being greater than the height of each port, w) the distance from the top of each port to the top of the rotor being greater than the height of each port, x) the rotor with the vanes and ports is so designed and constructed that in use a rock pack forms from the leading face of each vane to the trailing lip of a port and from top of the rotor to the top of each port, and from the bottom of the rotor to the bottom of the ports, y) a free rotating table on bearings above the bottom of the rotor, z) said table mounted rotatable to and co-axially with said rotor and said shaft, aa) a tungsten carbide top on said table.

bb) the side wall of the rotor is a single unitary cylindrical shell of metal with cc) an integral cylindrical outer surface; except for three ports, thereby having no elements outside the walls to be battered and come loose from the rotor, ee) a lip pin constructed of a tungsten carbide, ff) said pin telescoped and adhered within a steel pipe, gg) said pipe welded in position at the trailing lip parallel to said shaft, hh) a top pin attached along the top of each of the ports, ii) a bottom pin attached along the bottom of each of the ports, jj) said top and bottom pins telescoped and adhered in steel pipes in the same manner as the lip pin, kk) all pins for a port attached to a mounting plate, ll) said mounting plates having a rectangular opening therein which matches the port, and mm) each of said mounting plates attached to the inside of the side wall over a corresponding port.

17. In a rock crusher having a) a vertical rotatable shaft having a top, b) a motor mechanically connected to the shaft for rotating the shaft, c) a rotor with a top and a bottom connected to the top of the shaft, d) a feeder located above the shaft adapted to feed rock into an opening in the top of the rotor, e) a side wall on the rotor enclosing the rotor, f) ports in the side wall, g) each port having a leading lip, a trailing lip, a top and a bottom, h) a vane extending into the rotor from the sidewall adjacent each port, i) each vane having a leading face and a trailing face;

j) an anvil horizontally surrounding and enclosing the rotor, k) so arranged and constructed that rocks fed into the rotor when rotating will be slung from the ports against the anvil;

the improved structure for reducing maintenance by reducing abrasion by forming a rock face entirely covering the leading face of each vane comprising:

l) the leading face of each vane forming an acute angle with the side wall, m) the trailing face of each vane forming an obtuse angle with the side wall, n) each leading lip on each port adjacent to a trailing face of the adjacent vane, o) each port having a height from top to bottom about equal to a width from the leading lip to the trailing lip, p) the distance from the bottom of each port to the bottom of the rotor being greater than the height of each port, and q) the distance from the top of each port to the top of the rotor being greater than the height of each port, r) the rotor with the vanes and ports is so designed and constructed that in use a rock pack forms from the leading face of each vane to the trailing lip of a port and from top of the rotor to the top of each port, and from the bottom of the rotor to the bottom of the ports.

* * * * *